US006811439B1

(12) United States Patent
Shin-Ting

(10) Patent No.: US 6,811,439 B1
(45) Date of Patent: Nov. 2, 2004

(54) THIN CONNECTOR

(75) Inventor: Yeh Shin-Ting, Shulin (TW)

(73) Assignee: L & K Precision Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 10/813,030

(22) Filed: Mar. 31, 2004

(51) Int. Cl.[7] ..... H01R 13/648
(52) U.S. Cl. ..... 439/607
(58) Field of Search ..... 439/607, 579, 439/497

(56) References Cited

U.S. PATENT DOCUMENTS 6,273,753 B1 * 8/2001 Ko ..... 439/579
6,338,652 B1 * 1/2002 Ko ..... 439/579
6,619,985 B1 * 9/2003 Ko ..... 439/607
6,648,668 B1 * 11/2003 Ko ..... 439/353
6,659,791 B1 * 12/2003 Ko et al. ..... 439/353

* cited by examiner

*Primary Examiner*—Tho D. Ta
(74) *Attorney, Agent, or Firm*—Troxell Law Office PLLC

(57) ABSTRACT

A thin connector is assembled on a PCB for signal transmission of an LCD, and has an insulative housing, a plurality of conductive terminals received in the insulative housing, a shell shielding the insulative housing and the conductive terminals, and a metal plate. The metal plate is sandwiched between the conductive terminals and the insulative housing and electrically connects with a grounding circuit of the PCB. An assembling arms upwardly extend from opposite side edges of the metal plate. Each assembling arm has a rear tab for mounting on the insulative housing. Each assembling arm defines a retaining hole at a bottom edge thereof for locking with a mating connector. The metal plate is close to the conductive terminals, so effectively reduces cross talking of the conductive terminals. Moreover, the retaining holes of the metal plate further assure firm engagement between the thin connector and the mating connector.

10 Claims, 6 Drawing Sheets

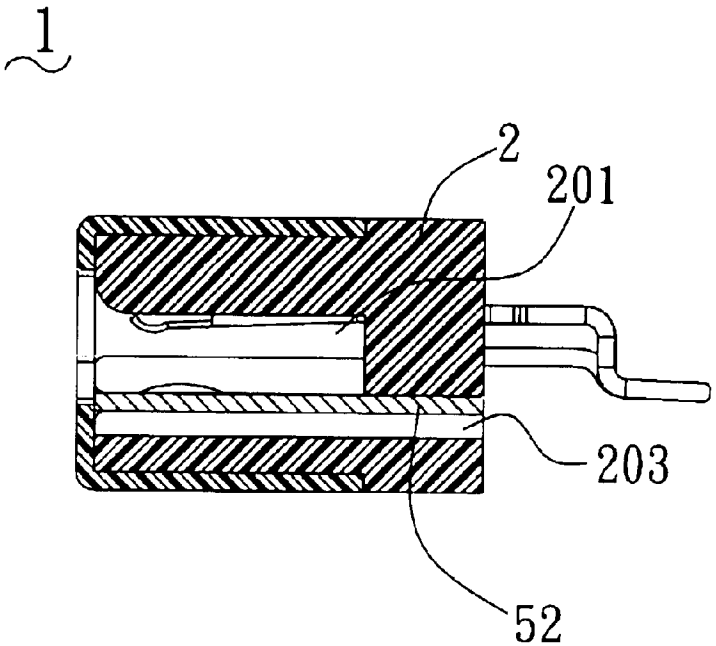
FIG. 8(8–8)
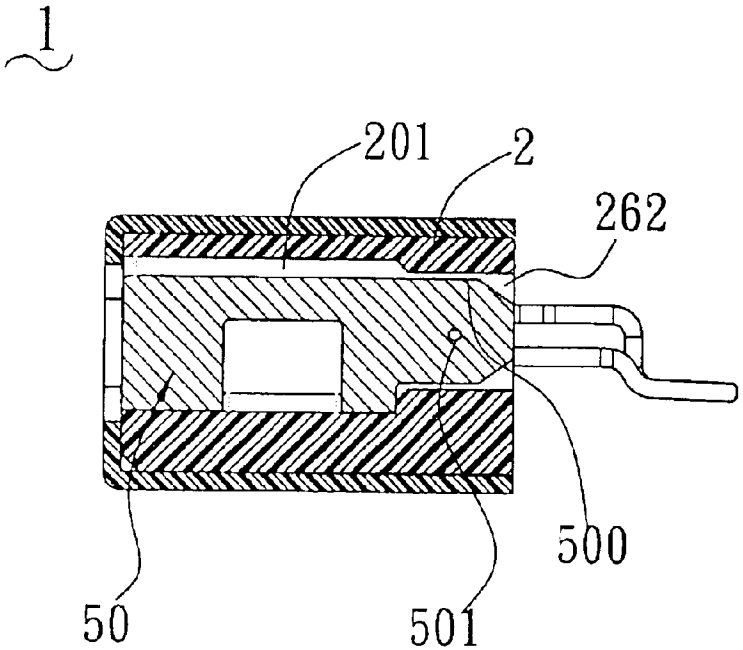
FIG. 7(7–7)

THIN CONNECTOR

BACKGROUND OF THE INVENTION

1. Field of the Invention

The present invention relates to a thin connector, and particularly to a thin connector which is assembled on a printed circuit board (PCB) for communicating with a Liquid Crystal Display (LCD) and which shields from interference and firmly mates with a mating connector.

2. Related Art

A connector, which is assembled on a mainboard for communicating with LCD, is always required to transfer numerous data. Correspondingly, such a connector has a number of conductive terminals thereon. The connector often has small size, so the conductive terminals are mounted closely. The connector usually has a metal shell around an insulative housing for avoiding external interference thereby assuring transmission quality.

However, conductive terminals mounted closely tend to produce cross talking, resulting unreliable signal transmission. Additionally, the LCD needs to be opened or closed frequently, so the connector is apt to disengage from a mating connector, making signal transmission halting.

SUMMARY OF THE INVENTION

Accordingly, an object of the present invention is to provide a thin connector having good shielding performance and reliably mating with a mating connector.

The thin connector of the present invention comprises an insulative housing, a plurality of conductive terminals received in the insulative housing, a shell shielding the insulative housing and the conductive terminals, and a metal plate sandwiched between the conductive terminals and the insulative housing. Assembling arms upwardly extend from opposite side edges of the metal plate. Each assembling arm has a rear tab for locking with fastening portions of the insulative housing. Each assembling arm defines a retaining hole at a bottom edge thereof for locking with a mating connector.

A plurality of locking tails rearwardly extends from a rear edge of the metal plate for locking with the insulative housing. Grounding arms extend from a rear of the metal plate and adjacent to the assembling arms and form soldering tails for surface soldering on a grounding circuit of a mainboard.

BRIEF DESCRIPTION OF THE DRAWINGS

FIG. 7 is a cross-sectional view taken along the line 7—7 in FIG. 6.

FIG. 8 is a cross-sectional view taken along the line 8—8 in FIG. 6.

DESCRIPTION OF THE PREFERRED EMBODIMENTS

Figure 1:
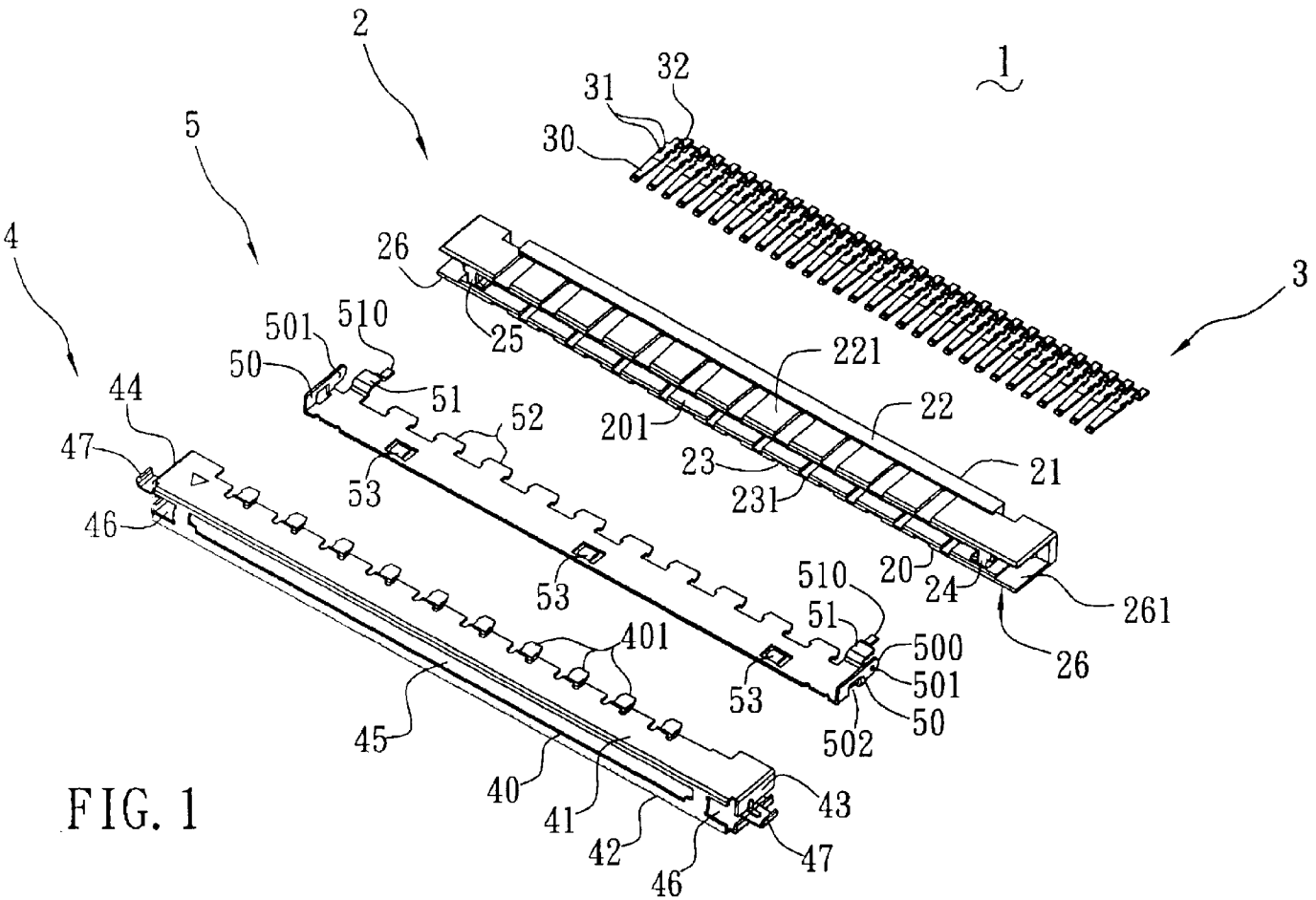
FIG. 1 is an exploded view of a thin connector of the present invention.
Figure 5:
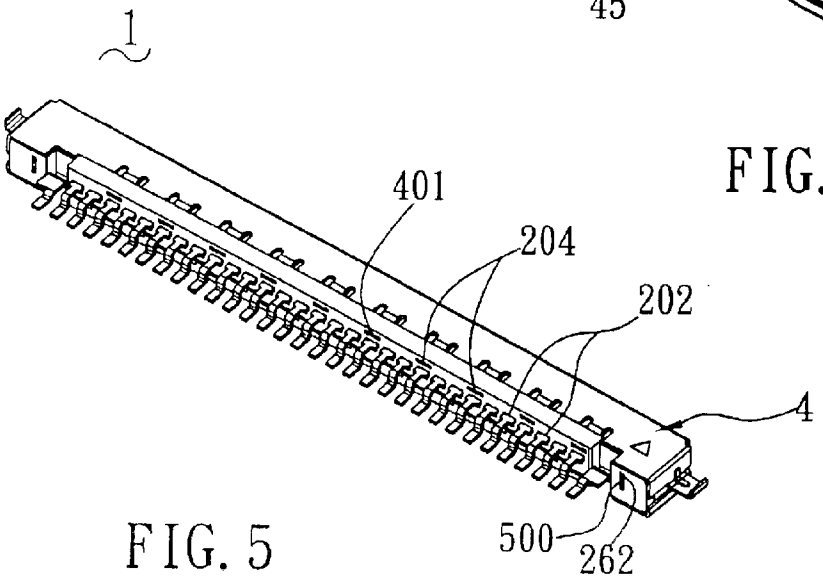
FIG. 5 is an upside-down view of the thin connector of FIG. 4.

With reference to FIG. 1, a thin connector 1 of the present invention comprises an insulative housing 2, a plurality of conductive terminals 3, a shell 4, and a metal plate 5. The insulative housing 2 is substantially rectangular, and forms a mating wall 20 and a connecting wall 21 opposite to each other. The insulative housing 2 further forms a top wall 22 at a top, a bottom wall 23 at a bottom, and a pair of side walls 24, 25 between the mating wall 20 and the connecting wall 21. A first opening 201 is defined longitudinally through the mating wall 20 for accommodating a mating connector (not shown). A plurality of passageways 202 (shown in FIG. 5) is transversely defined through the mating wall 20 and the connecting wall 21 for receiving the conductive terminals 3 therein. A plurality of plug holes 203 (shown in FIG. 8) is transversely defined through the mating wall 20 and the connecting wall 21 and below the passageways 202. A plurality of fixing grooves 204 (shown in FIG. 5) is defined in the mating wall 20 and over the passageways 202. The insulative housing 2 has a pair of fastening portions 26 respectively extending outwardly from and being unitarily formed with the side walls 24, 25. Each fastening portion 26 has a top aligned with the top wall 22, a bottom aligned with the bottom wall 23, and a rear aligned with the connecting wall 21. Each fastening portion 26 defines a fastening room 261 toward a front thereof for receiving a fastening element of the mating connector (not shown). An assembling holes 262 (shown in FIGS. 5 and 7) are defined in the side walls 24, 25 and communicate with the fastening rooms 261. A plurality of top platform 221 is extended from the top wall 22 and a plurality of bottom platform 231 is formed on the bottom wall 23 for latching with the shell 4 when assembly.

Each conductive terminal 3 comprises a contact portion 30, a soldering portion 32 and an interferential portion 31 between the contact portion 30 and the soldering portion 32. The shell 4 forms a first shielding wall 40, a second shielding wall 41, a third shielding wall 42 and a pair of side shielding walls 43, 44 respectively for shielding the mating wall 20, the bottom wall 22, the top wall 21, the bottom wall 23, the side walls 24, 25 and the fastening portions 26 of the insulative housing 2. A second opening 45 is defined longitudinally through the first shielding wall 40 for corresponding to the first opening 201. A receiving cavities 46 are respectively defined in both sides of the first shielding wall 40 for corresponding to the receiving rooms 261. Further referring to FIG. 5, a plurality of fixing tails 401 extends rearwardly from the shell 4 for anchoring the fixing grooves 204 of the insulative housing 2. Legs 47 outwardly extend from the side shielding walls 43, 44 for surface soldering to a mainboard (not shown).

The metal plate 5 is substantially rectangular for being sandwiched between the conductive terminals 3 and the insulative housing 2. Assembling arms 50 upwardly extend from opposite side edges of the metal plate 5. Each assembling arm 50 has a rear tab 500 for locking with the assembling hole 262 of the fastening portion 26. A plurality of protuberances 501 projects from the rear tabs 500 for interferentially locking with the assembling holes 262 (shown in FIG. 7). A retaining hole 502 is defined at a bottom edge of each assembling arm 50 for locking with a fastening element of the mating connector. Grounding arms 51 extend from a rear of the metal plate 5 and adjacent to the assembling arms 50. Each ground arm 51 has a soldering tail 510 bended appropriately therefrom for surface soldering on a grounding circuit of the mainboard. A plurality of locking tails 52 rearwardly extends from a rear edge of the metal plate 5 for locking with the plug holes 203 of the insulative housing 2. A plurality of spring tongues 53 is formed on the metal plate 5 for abutting against the mating connector.

Figure 2:
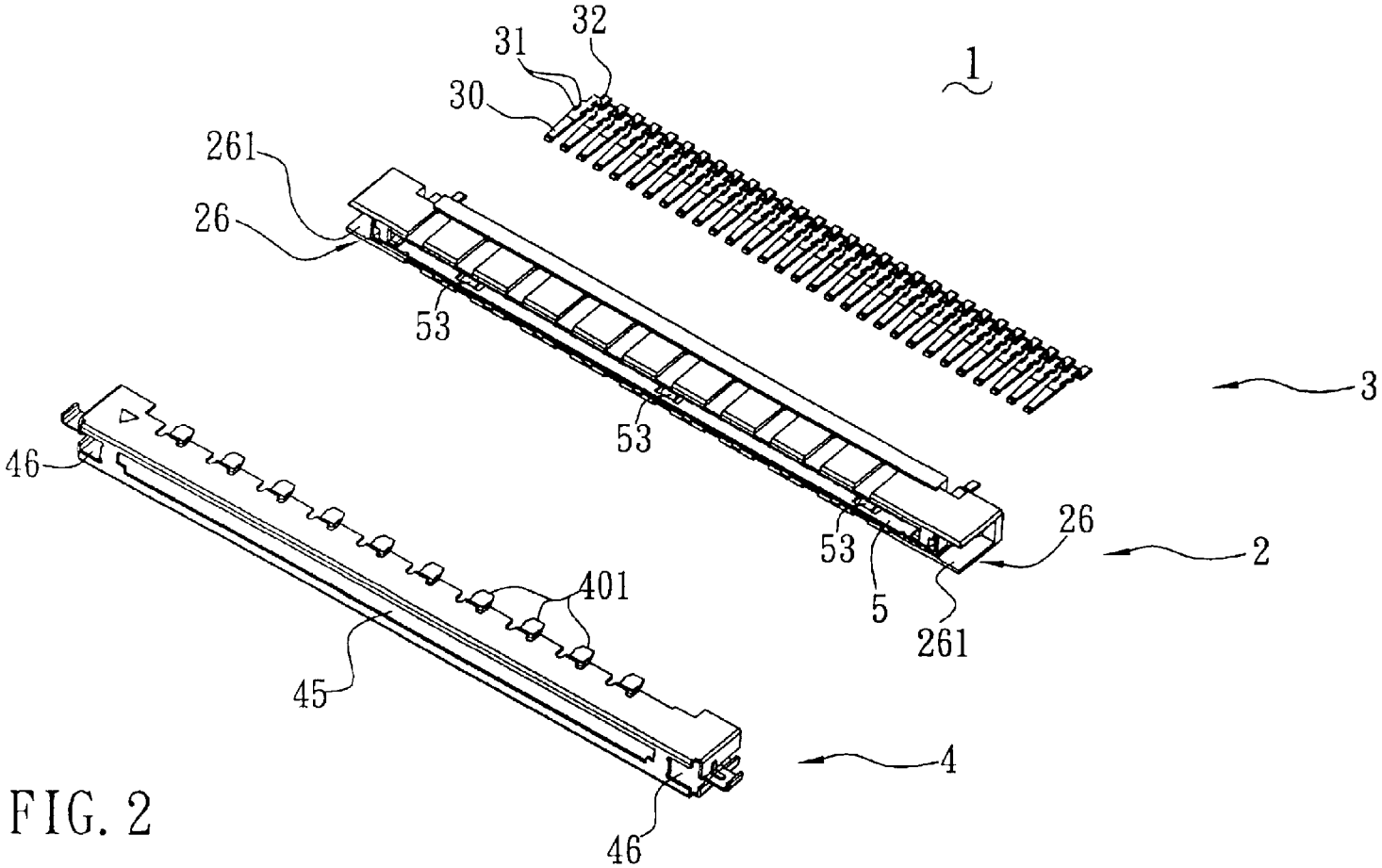
FIGS. 2–4 are assembled view of the thin connector of FIG. 1.
Figure 3:
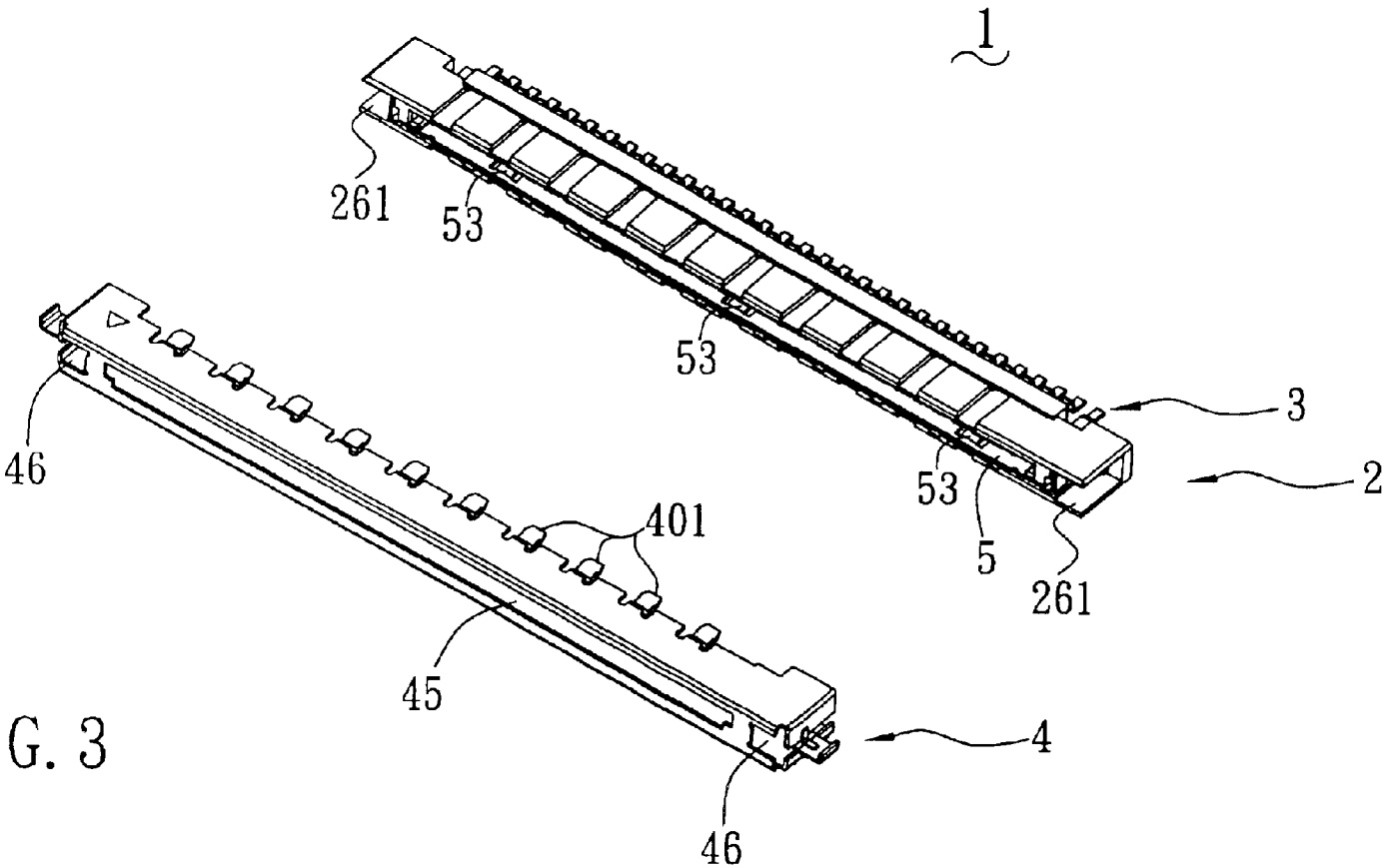
Figure 4:
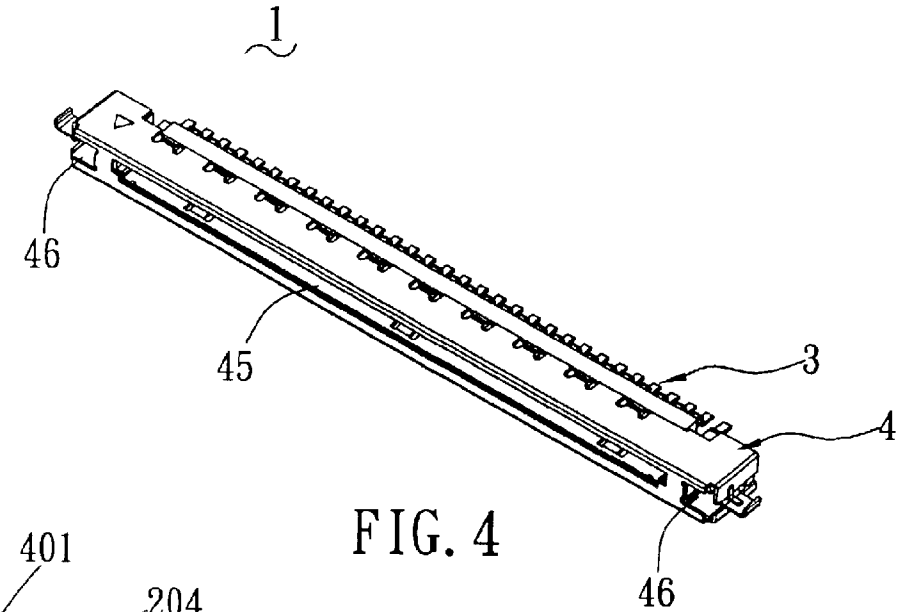
Figure 6:
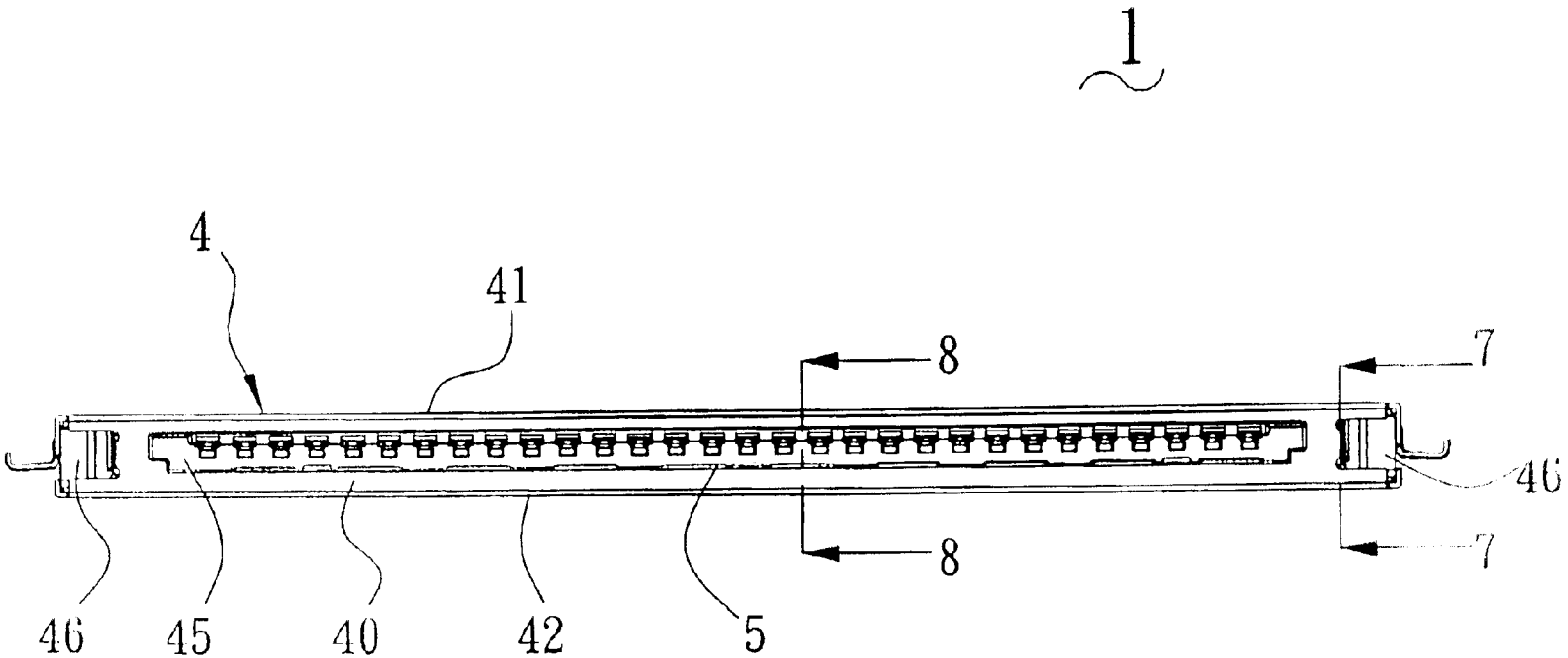
FIG. 6 is a front view of the thin connector of FIG. 4.

In assembly, referring to FIG. 2, the metal plate 5 is inserted into the insulative housing 2. The locking tails 52 lock with the plug holes 203 of the insulative housing 2, as shown in FIG. 8. The rear tabs 500 latch with the assembling holes 262 of the fastening portions 26, as shown in FIG. 7. Further referring to FIGS. 2-5, the conductive terminals 3 are received in the passageways 202. The shell 4 surrounds the insulative housing 2. The fixing tails 401 of the shell 4 anchor the fixing grooves 204 of the insulative housing 2. Further referring to FIG. 6, the second shielding wall 41 of the shell 4 and the metal plate 5 cooperate with each other to shield the conductive terminals 3 reliably, and especially the metal plate 5 is close to the conductive terminals 3, thus effectively reducing cross talking produced by the conductive terminals 3, and making capacity of the thin connector 1 increasing to obtain impedance match for stable signal transmission.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A thin connector adapted to be assembled on a PCB for signal transmission, comprising:

an insulative housing being substantially rectangular and having a mating wall and a connecting wall opposite to each other, a top wall at a top, a bottom wall at a bottom, and a pair of side walls between the mating wall and the connecting wall, a first opening being defined longitudinally through the mating wall for accommodating a mating connector, a plurality of passageways being transversely defined through the mating wall and the connecting wall, a pair of fastening portions respectively extending outwardly from the side walls, and each fastening portion defining a fastening room toward a front thereof for receiving a fastening element of a mating connector, an assembling holes being defined in the side walls and communicating with the fastening room;

a plurality of conductive terminals received in the passageways, and each conductive terminal including a contact portion, a soldering portion and an interferential portion between the contact portion and the soldering portion;

a shell forming a first shielding wall, a second shielding wall, a third shielding wall and a pair of side shielding walls respectively for shielding the mating wall, the bottom wall, the top wall and the fastening portions of the insulative housing, a second opening being defined longitudinally through the first shielding wall for corresponding to the first opening of the insulative housing, a receiving cavities being respectively defined in both sides of the first shielding wall for corresponding to the receiving rooms of the fastening portions; and a metal plate being substantially rectangular and sandwiched between the conductive terminals and the insulative housing, assembling arms upwardly extending from opposite side edges of the metal plate, each assembling arm having a rear tab for locking with the fastening portions and defining a retaining hole at a bottom edge thereof for locking with the mating connector.

2. The thin connector as claimed in claim 1, wherein the fastening portions are integrated with the side walls of the insulative housing, and each fastening portion has a top aligned with the top wall, a bottom aligned with the bottom wall, and a rear aligned with the connecting wall.

3. The thin connector as claimed in claim 1, wherein a plurality of locking tails rearwardly extends from a rear edge of the metal plate, and wherein a plurality of plug holes is transversely defined through the mating wall and the connecting wall of the insulative housing and below the passageways for locking with the locking tails, thereby retaining the metal plate on the insulative housing.

4. The thin connector as claimed in claim 3, further comprising a grounding arms extend from a rear of the metal plate and adjacent to the assembling arms, and each grounding arm has a soldering tail bended appropriately therefrom for surface soldering on a grounding circuit of the PCB.

5. The thin connector as claimed in claim 4, further comprising a retaining hole defined at a bottom edge of each assembling arm for locking with a fastening element of the mating connector.

6. The thin connector as claimed in claim 5, wherein a plurality of protuberances projects from the rear tabs of the metal plate for interferentially locking with the fastening portions.

7. The thin connector as claimed in claim 6, wherein a plurality of top platform is formed on the top wall and a plurality of bottom platform is formed on the bottom wall for latching with the shell in assembly.

8. The thin connector as claimed in claim 7, wherein legs outwardly extend from the side shielding walls of the shell for surface soldering to the PCB.

9. The thin connector as claimed in claim 8, wherein a plurality of fixing grooves is defined in the mating wall of the insulative housing, and wherein a plurality of fixing tails extends rearwardly from the shell for anchoring the fixing grooves.

10. The thin connector as claimed in claim 9, wherein a plurality of spring tongues is formed on the metal plate for abutting against the mating connector.

* * * * *